United States Patent [19]

Jones et al.

[11] 4,324,377

[45] Apr. 13, 1982

[54] SAFETY KNIFE HOLDER

[76] Inventors: Allan P. Jones, 7340 Amestoy, Van Nuys, Calif. 91406; Patrick L. Reichstein, 44808 Lorimer Ave., Lancaster, Calif. 93534

[21] Appl. No.: 93,302

[22] Filed: Nov. 13, 1979

[51] Int. Cl.[3] ..... A47G 21/14

[52] U.S. Cl. ..... 248/37.6; 248/314

[58] Field of Search ..... 248/37.3, 37.6, 309 R, 248/309 A, 314; 211/60 T, 63, 60 A

[56] References Cited

U.S. PATENT DOCUMENTS

| | | | |
|---|---|---|---|
| 919,896 | 4/1909 | Lemke | 211/88 X |
| 1,452,816 | 4/1923 | Reimer | 248/314 |
| 1,569,508 | 1/1926 | Lee | 248/37.6 |
| 1,989,974 | 2/1935 | Elias | 248/311.2 X |
| 2,124,541 | 7/1938 | Cassey | 211/88 U X |
| 2,292,959 | 8/1942 | Monson | 248/311.2 X |
| 2,453,800 | 11/1948 | Lowell | 248/37.6 |
| 2,571,972 | 10/1951 | Wagner | 248/37.6 |
| 4,001,444 | 1/1977 | Clarke | 211/74 X |

FOREIGN PATENT DOCUMENTS

| | | | |
|---|---|---|---|
| 612067 | 11/1948 | United Kingdom | 248/312 |

*Primary Examiner*—J. Franklin Foss

*Attorney, Agent, or Firm*—Sanford Astor

[57] ABSTRACT

This invention relates to a safety device for holding a knife primarily for commercial use in restaurants, and stores. The holder is an elongated raised portion primarily made of stainless steel with a flange on each side. The elongated portion slants from a wider opening for insertion of knife back to a rear portion flush with the counter. The holder is slidably attached over or under the counter or other surface by side rail holders or mounting brackets, one holder on each side to slidably receive the flanges. The holder is easily removed for cleaning.

1 Claim, 6 Drawing Figures

SAFETY KNIFE HOLDER

This invention was registered with the Patent Office as a Disclosure Document No. 071682 on May 30, 1978.

BACKGROUND OF THE INVENTION

In restaurants, lunch counters, kitchens and the like the chef or cook has constant use of a knife. In general, (for chopping and cutting various types of vegtables and foods) there is one particular sharp knife that is used with regularity. There are a variety of places that the chef or cook can place the knife for easy access, but until the present time there has been no specific place that the knife can be placed for safe easy access and easy use.

In addition, the knife has to be placed in a location where the handle is exposed so that it can be grasped easily, used and replaced. That location, in addition, must be a place where the edge of the knife is not exposed where it might cut someone.

OBJECTS OF THE INVENTION

It is the object of the present invention to provide a readily accessible, sanitary receptacle for the knife used in a restaurant kitchen.

A further object of the invention is to provide a sanitary receptacle which is itself removable for easy cleaning.

Still a further object of the invention is to provide a receptacle for the knife which may be mounted in an inconspicuous out-of-the-way manner and yet provide easy access for the knife.

With the above and other objects in view, the invention is disclosed by reference to the following drawings which:

Figure 1:
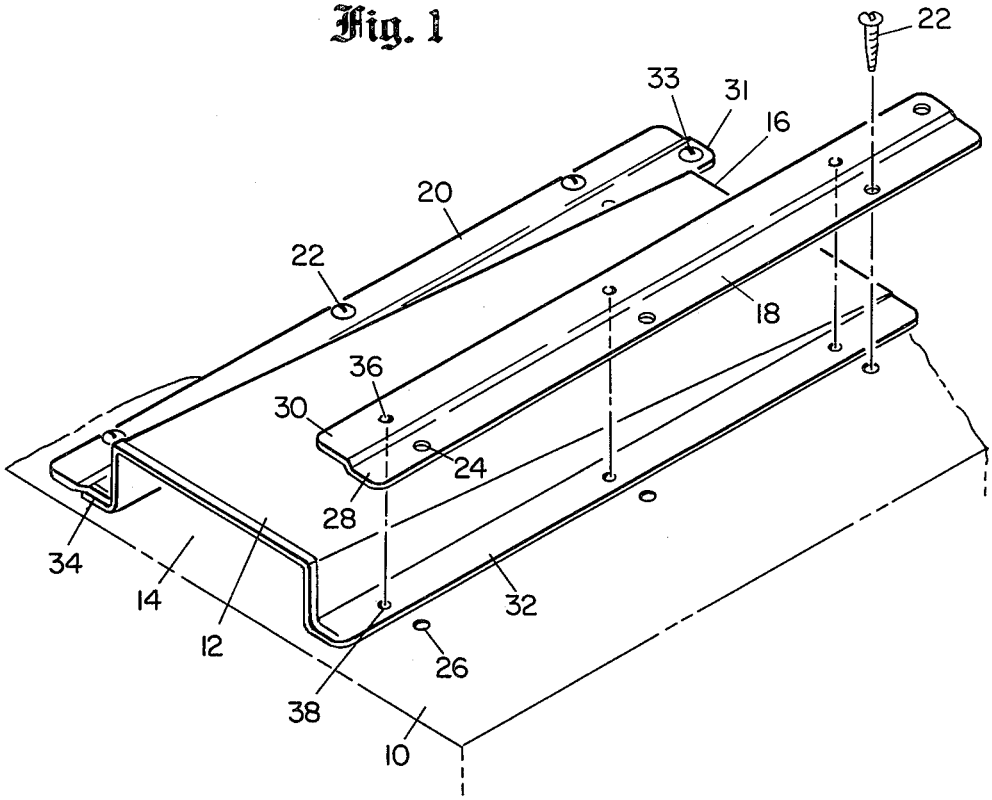
FIG. 1 is a perspective view of the device of the present invention.

Referring now to FIG. 1 there is shown a table 10 upon which is mounted the elongated body section, 12 which has an opening 14 adapted to receive the blade of the knife (not shown). The body section 12 is slanted from a wider opening at area 14 down to a nearly closed section at the opposite end 16. The elongated body 12 is held securely to the table 10 by two rail holders or mounting brackets 18 and 20. Mounting bracket 18 is shown raised above the table while mounting bracket 20 is shown secured to the table. The mounting brackets 18 and 20 are secured to the table by screws such as 22 which are fixedly attached, through holes such as 24 in the mounting brackets, directly to the table at points such as 26.

The mounting brackets or rail holders 18 and 20 have two portions, a lower portion 28 which portion contains the holes 24 for mounting to table 10 and slightly raised portions 30 and 31 which are slightly raised in order to receive the flanges 32 and 34 of the body portion 12. Thus when the rail holders 18 and 20 are securely fixed to the table 10 the flanges 32 and 34 can be slidably received under the raised portions 30 and 31 of the rail holders and slidably held in place until the body portion needs to be removed for cleaning at which time it can be slidably removed from under the rail holders 18 and 20.

Figure 2:
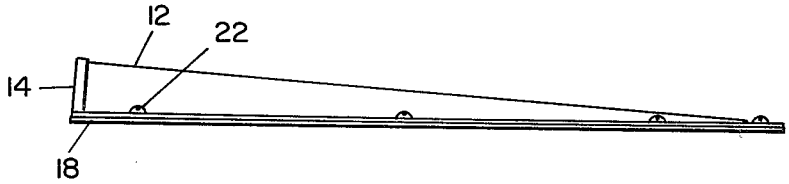
FIG. 2 is a side view of the device of the present invention.

Referring now to FIG. 2 there is shown a side view of the knife holder of the present invention which shows the rail holder 18 secured by screw 22 and the slanted body portion 12 with opening 13 for insertion of a knife.

Figure 3:
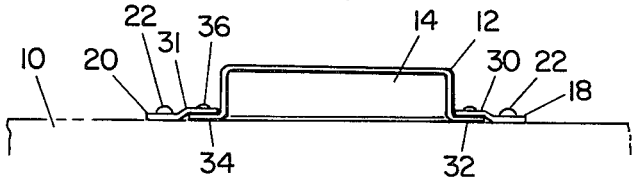
FIG. 3 is an end view of the device of the present invention.

Referring now to FIG. 3 there is shown the table 10 with the body portion 12 having opening 14 for the knife and with the flanges 32 and 34 slidably received under the rail holders or mounting brackets 18 and 20. The mounting holders 18 and 20 are securely held to the table by screws 22. The raised portion 30 and 31 of the mounting holders can be seen providing a small space in which the flanges 32 and 34 of the body 12 can be slidably received. The raised pips 36 can also be seen on the raised portion 30 and 31 of the mounting brackets which provide a stop or catch for holding the body 12 underneath the mounting brackets 18 and 20.

The device of the present invention may be secured in this manner either on top of or underneath a table top, depending upon the choice of the chef or cook and may also be fastened to the side of a table if desired. The knife holder of the present invention may be made from any convenient material which is desired, such as, metal or plastic, aluminum, stainless steel, and the like, although for most sanitary operation and durability stainless steel is used.

Figure 4:
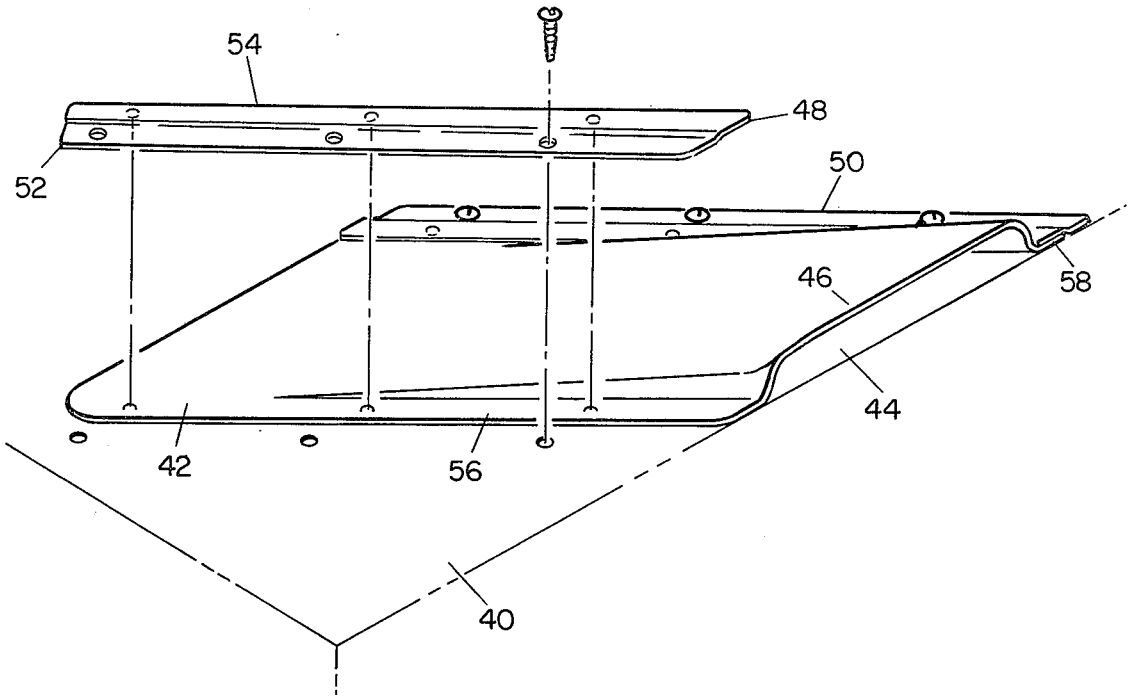
FIG. 4 is a perspective view of another aspect of the present invention.

FIG. 4 describes another aspect of the present invention in which a horizontally slanted variety of the knife holder of the present invention, is shown if desired for convenience of the chef. In FIG. 4 there is shown a table 40 the body of the knife holder 42 and in this instance instead of a flat top surface of body 42 raising to the opening 44 in the body 42 there is a raised lip 46 at the opening end of body 42 which provides more room for insertion of the knife than the aspect described in FIG. 1. This raised lip can also be used in the aspect shown in FIG. 1. It may also be used as a handle to remove the knife holder for cleaning. In FIG. 4 the body portion 42 is slanted at an angle such as 45 degrees, more clearly shown in FIG. 5 to the front edge of the table 40. This again may be done for two reasons. The chef may prefer the knife to be at an angle slanted to the table or perhaps the more important reason, is that in many counters or tables there is not enough depth for the knife to be at a 90 degree angle to the front of the table. The knife will be too long and will hit the back of the table or the wall and stick out of the holder. By providing a knife holder horizontally slanted to the front edge of the table, at an angle such as 45 degrees, the entire length of the knife can fit into the holder. Again the mounting brackets 48 and 50 are provided with a portion 52 to be secured to the table and a portion 54 which is raised in order to receive the flanges 56 and 58 of the body portion 42.

Figure 5:
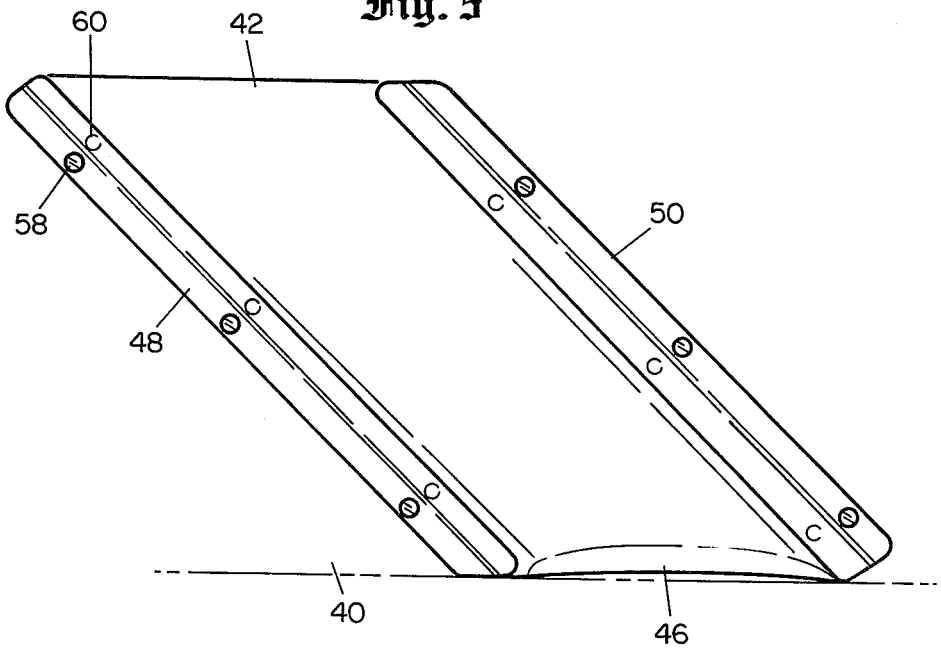
FIG. 5 is a top view of another aspect of the present invention.

Referring now to FIG. 5, there is shown a top view of the aspect of the invention shown in FIG. 4 with the table 40 and the body portion 42 which is slanted at an angle to the front of the table 30. The front portion of the body 42 has a raised lip 46 for easier insertion of the knife. The mounting brackets 48 and 50 are secured to the table by screws 58 and again have raised pips 60 for securing of the body portion 42 underneath the mounting brackets 48 and 50.

Figure 6:
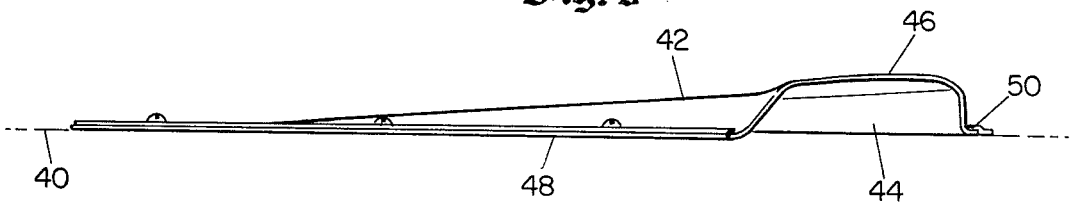
FIG. 6 is a side view of the device shown in FIG. 5.

Referring now to FIG. 6, there is shown a side view of the aspect of FIG. 4 in which the body portion of the knife holder 42 is secured to the table 40 by the mounting brackets 48 and 50. The opening 44 of the knife holder 42 with the raised lip portion 46 is more clearly shown in FIG. 6.

The knife holder of the present invention as thus described is safe, provides easy accessibility and can be mounted in any convenient angle. This provides safety, in that the knife is always out of the way and not lying on top of the counter where a cut may occur. At the end of each day the body portion of the knife holder 12 may be slidably removed from underneath the holders and put into a dishwasher or washed and cleaned in any manner desired and replaced underneath the mounting brackets. While the body portion of the knife holder is removed a cloth may be used to clean the counter surface beneath the place between the rail holders where the body portion was removed.

With more and more importance being placed on occupational safety, the knife holder of the present invention provides a very safe out-of-the-way place to keep a knife which is regularly used and yet provide easy access for the chef or cook.

An additional aspect of the invention for added protection and positioning is that the mounting brackets or railholders 18 and 20 extend past the end of flat portion of the body 16 with a screw attached to the table at a position 33. This screw 33 and the extension of the rail holders slightly longer than the body portion 12 provides a stop or positioning device for the body portion 12 so that the front edge of the body portion is exactly flush with the edge of table 10, so that it is always positioned right at the edge of the counter.

Having thus described the invention it is desired that the scope of the patent be limited only by the scope of the appended claims.

We claim:

1. A Safety Knife holder comprising an elongated body portion, said body portion slanting from a raised open end to a narrow closed end, adapted to frictionally receive and hold the blade end of a knife, rail holders fixedly attached to a table to slidably receive said body portion, flanges at each side of said body portion, in which one side of said rail holders is securable to a table and the other side is slightly raised for receiving of said flanges, in which said rail holders have pips adapted to match pips on the flanges for positioning of the body portion, a raised lip at the open end of said body portion.

* * * * *